US005611553A

United States Patent [19]

Schoeman et al.

[11] Patent Number: 5,611,553

[45] Date of Patent: Mar. 18, 1997

[54] ELECTRONIC GAME STORAGE CART

[76] Inventors: Frederick Schoeman; Francina A. Schoeman, both of 805 Atkins Ct., Cumming, Ga. 30131

[21] Appl. No.: 440,487

[22] Filed: May 12, 1995

[51] Int. Cl.[6] ..... B32B 3/00

[52] U.S. Cl. ..... 280/47.35; 280/79.2; 312/223.3; 312/223.6

[58] Field of Search ..... 280/47.35, 47.34, 280/79.11, 79.2, 79.3, 35; 369/75.1; D34/14, 19, 20, 21; 191/12.2 R; 248/328; 312/8.5, 8.12, 29, 107, 244, 270.3, 291, 292, 330.1, 334.14, 223.2, 223.3, 223.6, 351.11

[56] References Cited

U.S. PATENT DOCUMENTS

| | | | |
|---|---|---|---|
| 2,893,749 | 7/1959 | Simonsen | 280/79.2 |
| 2,981,549 | 4/1961 | Hotton | 280/79.2 |
| 3,170,710 | 2/1965 | Rachman | 280/79.2 |
| 3,897,855 | 8/1975 | Patterson | 280/79.2 |
| 4,120,549 | 10/1978 | Bureau | 280/47.35 |
| 4,976,450 | 12/1990 | Ellefson | 280/79.11 |
| 5,348,324 | 9/1994 | Trotta | 280/35 |
| 5,447,318 | 9/1995 | Gantz et al. | 280/47.35 |
| 5,509,672 | 4/1996 | Offerson | 280/47.35 |

*Primary Examiner*—Anne Marie Boehler

[57] ABSTRACT

An electronic game storage cart comprised of a cabinet having a first rectangular opening through a front wall thereof. The front wall has a plurality of rectangular openings therein disposed beneath the first rectangular opening. The front wall has an upper storage bin and a lower storage bin formed therein. The rear wall has a plurality of holes formed therethrough extending inwardly of the first rectangular opening in the front wall. The cabinet has four casters secured to each of four corners of a lower surface thereof. A sliding shelf is slidably coupled to a lower surface within the first rectangular opening of the cabinet.

2 Claims, 3 Drawing Sheets

FIG 3
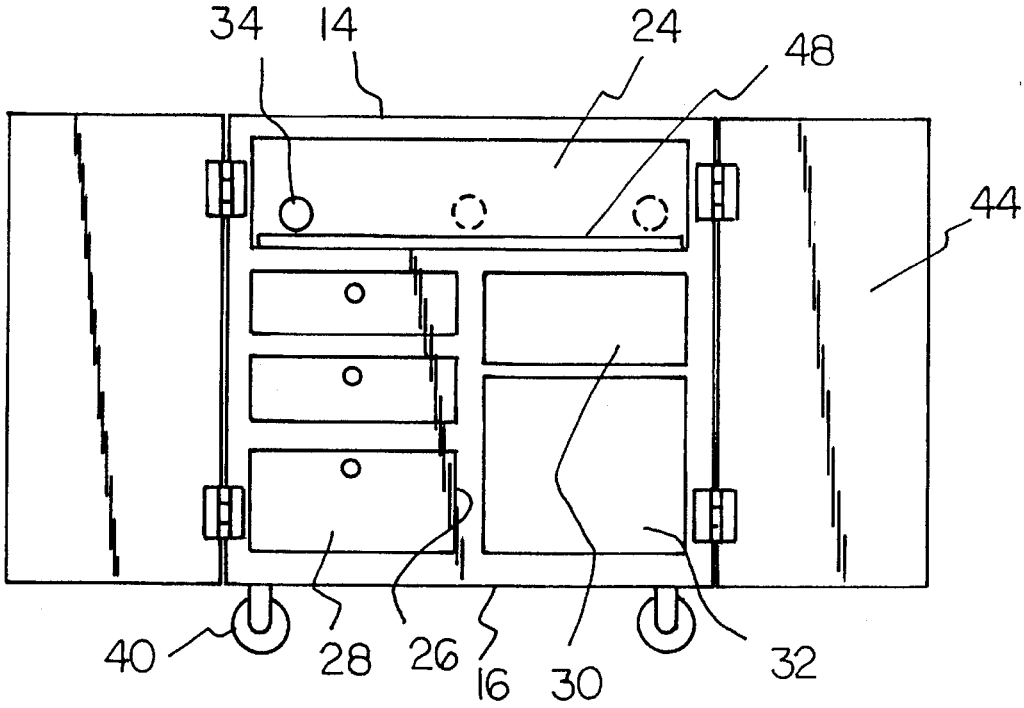
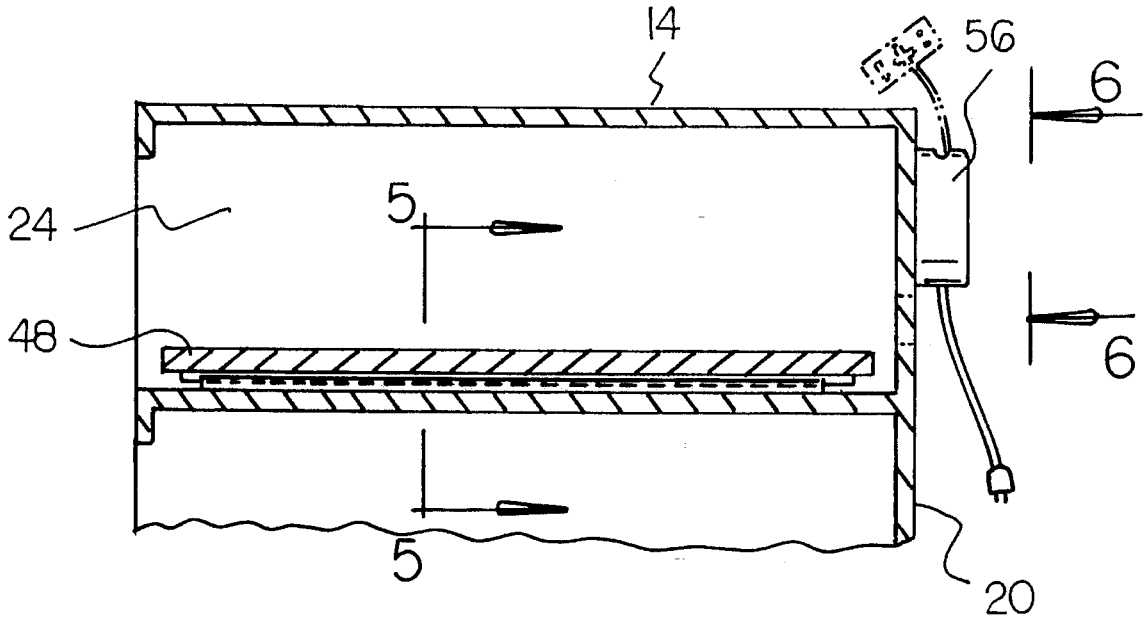
FIG 4

FIG 5
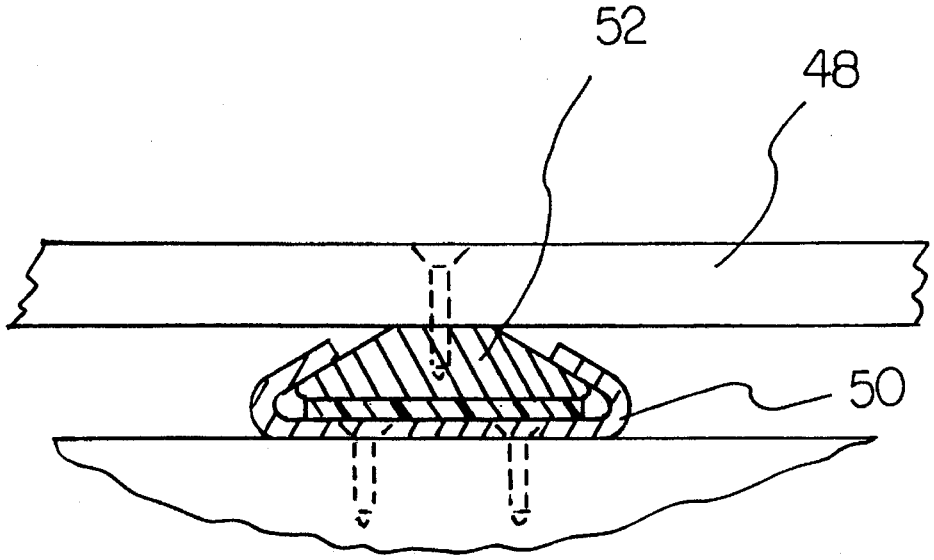
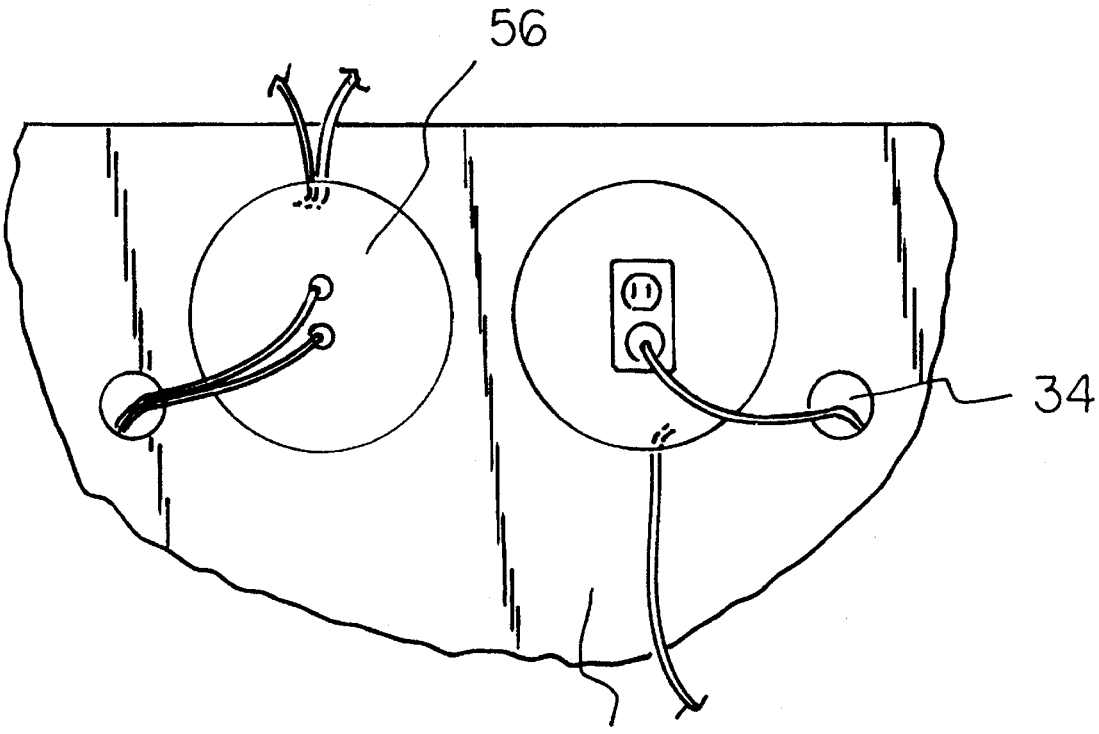
FIG 6

ELECTRONIC GAME STORAGE CART

BACKGROUND OF THE INVENTION

1. Field of the Invention

The present invention relates to an electronic game storage cart and more particularly pertains to storing games and game cartridges with an electronic game storage cart.

2. Description of the Prior Art

The use of storage cabinets is known in the prior art. More specifically, storage cabinets heretofore devised and utilized for the purpose of storing audio and video cassettes are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,297,675 to Martucci discloses a storage tray for audio/video cassette and game cartridges.

U.S. Pat. No. 5,246,284 to Merzon discloses a storage cabinet and cabinet module for selectively storing tape cassettes and discs.

U.S. Pat. No. 4,466,674 to La Rose discloses a home video game storage unit.

U.S. Pat. No. 4,440,458 to Berkman discloses a holder for video game and computer cartridges, video film cartridges, audio/video cassettes and their storage cases.

U.S. Pat. No. 4,394,055 to Smith discloses a cabinet for video game consoles, cartridges, accessories, and instruction booklets.

While these devices fulfill their respective, particular objective and requirements, the aforementioned patents do not describe an electronic game storage cart for storing games and game cartridges.

In this respect, the electronic game storage cart according to the present invention substantially departs from the conventional concepts and designs of the prior art, and in doing so provides an apparatus primarily developed for the purpose of storing games and game cartridges.

Therefore, it can be appreciated that there exists a continuing need for new and improved electronic game storage cart which can be used for storing games and game cartridges. In this regard, the present invention substantially fulfills this need.

SUMMARY OF THE INVENTION

In the view of the foregoing disadvantages inherent in the known types of storage cabinets now present in the prior art, the present invention provides an improved electronic game storage cart. As such, the general purpose of the present invention, which will be described subsequently in greater detail, is to provide a new and improved electronic game storage cart and method which has all the advantages of the prior art and none of the disadvantages.

To attain this, the present invention essentially comprises a cabinet having a top end, a bottom end, a front wall, a rear wall, and two side walls. The front wall has a first rectangular opening therein. The front wall has a plurality of rectangular openings therein disposed beneath the first rectangular opening. The plurality of rectangular openings have drawers removably coupled therein. The front wall has an upper storage bin and a lower storage bin formed therein. The rear wall has a plurality of holes formed therethrough extending inwardly of the first rectangular opening in the front wall. The two side walls each have a handle secured thereto. One of the two side walls has a remote control holder secured thereto. The bottom end has four casters secured to each of four corners thereof. The device contains a pair of doors hingedly secured to the front wall of the cabinet. The pair of doors serve to cover the front wall of the cabinet. The device contains a sliding shelf slidably coupled to a lower surface within the first rectangular opening of the cabinet. The sliding shelf comprises a U-shaped bracket secured to the lower surface of the first rectangular opening. The sliding shelf having a securement portion secured thereto slidably engaging the U-shaped bracket for the sliding in and out of the sliding shelf. The device contains a plurality of retractable reels secured to the rear wall of the cabinet. One of the retractable reels is adapted for use with an AC power cord. One or more of the other retractable reels is adapted for game remote control units.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved electronic game storage cart which has all the advantages of the prior art storage cabinets and none of the disadvantages.

It is another object of the present invention to provide a new and improved electronic game storage cart which may be easily and efficiently manufactured and marketed.

It is a further object of the present invention to provide a new and improved electronic game storage cart which is of durable and reliable construction.

An even further object of the present invention is to provide a new and improved electronic game storage cart which is susceptible of a low cost of manufacture with regard to both materials and labor, and which accordingly is then susceptible of low prices of sale to the consuming public, thereby making such an electronic game storage cart economically available to the buying public.

Still yet another object of the present invention is to provide a new and improved electronic game storage cart which provides in the apparatuses and methods of the prior art some of the advantages thereof, while simultaneously overcoming some of the disadvantages normally associated therewith.

Even still another object of the present invention is to provide a new and improved electronic game storage cart for storing games and game cartridges.

Lastly, it is an object of the present invention to provide a new and improved electronic game storage cart comprised of a cabinet having a first rectangular opening through a front wall thereof. The front wall has a plurality of rectangular openings therein disposed beneath the first rectangular opening. The front wall has an upper storage bin and a lower storage bin formed therein. The rear wall has a plurality of holes formed therethrough extending inwardly of the first rectangular opening in the front wall. The cabinet has four casters secured to each of four corners of a lower surface thereof. A sliding shelf is slidably coupled to a lower surface within the first rectangular opening of the cabinet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front elevation view of the present invention.

FIG. 4 is a cross-sectional view of present invention illustrating the sliding shelf.

FIG. 5 is a cross-sectional view as taken along line 5—5 of FIG. 4.

FIG. 6 is a cross-sectional view as taken along line 6—6 of FIG. 4.

The same reference numerals refer to the same parts through the various Figures.

DESCRIPTION OF THE PREFERRED EMBODIMENT

Figure 1:
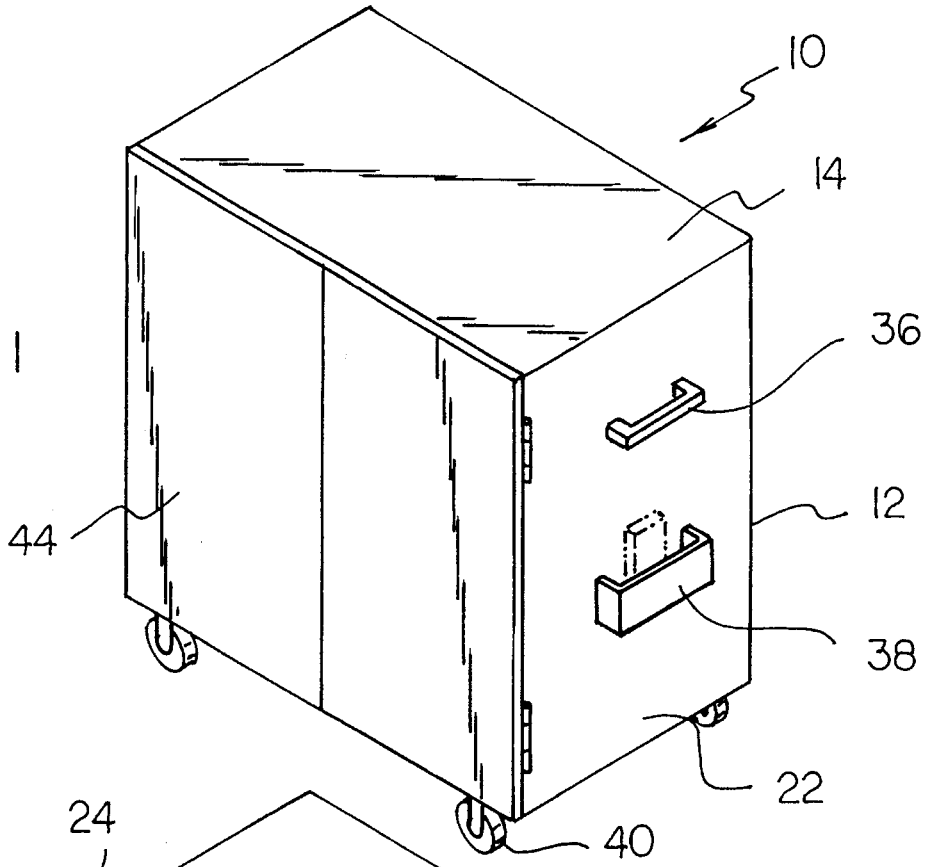
FIG. 1 is a perspective view of the preferred embodiment of the electronic game storage cart constructed in accordance with the principles of the present invention.
Figure 2:
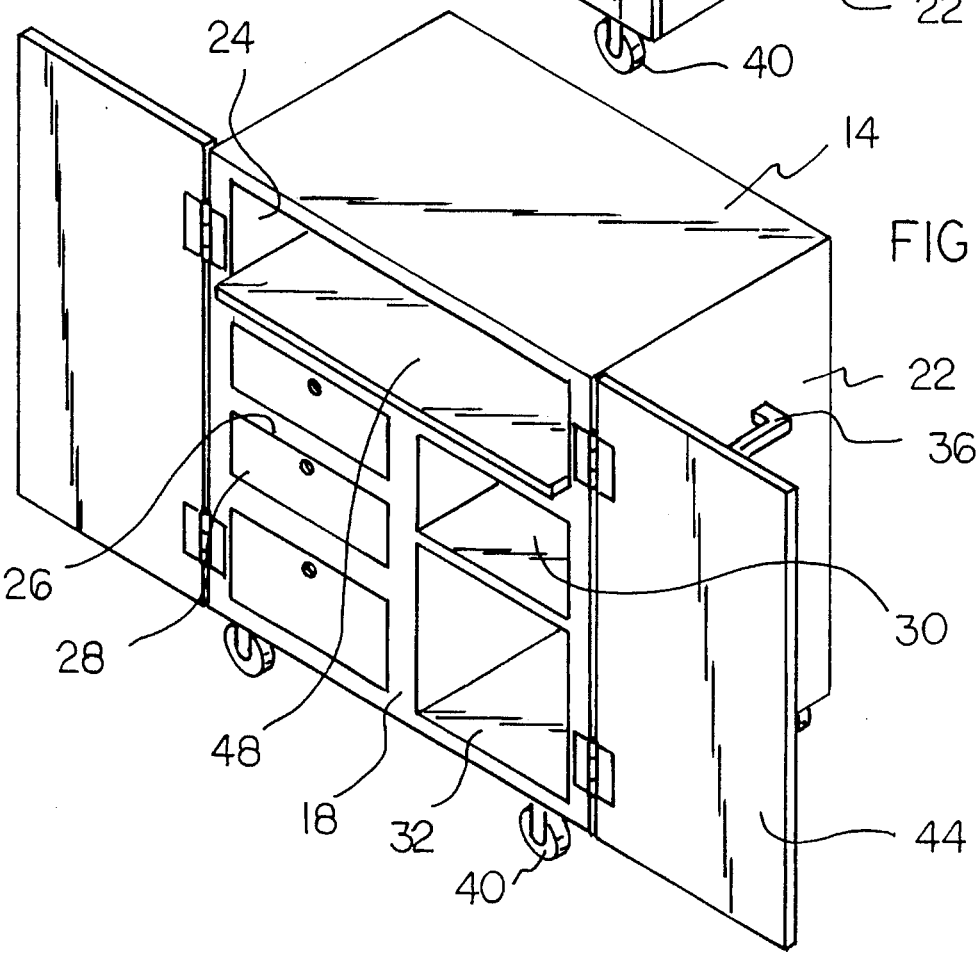
FIG. 2 is a perspective view of the present invention with the doors in an open position.

With reference now to the drawings, and in particular, to FIGS. 1–6 thereof, the preferred embodiment of the new and improved electronic game storage cart embodying the principles and concepts of the present invention and generally designated by the reference number 10 will be described.

Specifically, it will be noted in the various Figures that the device relates to a new and improved electronic game storage cart for storing games and game cartridges. In its broadest context, the device consists of a cabinet, a pair of doors, a sliding shelf, and a pair of retractable reels.

The device contains 10 a cabinet 12 having a top end 14, a bottom end 16, a front wall 18, a rear wall 20, and two side walls 22. The front wall 18 has a first rectangular opening 24 therein. The front wall 18 has a plurality of rectangular openings 26 therein disposed beneath the first rectangular opening 24. The plurality of rectangular openings 26 have drawers 28 removably coupled therein. The plurality of rectangular openings 26 and the drawers 28 therein are not limited to being of the same dimensions but could be made in different sizes to accommodate the differing sizes of game cartridges for different video games. The front wall 18 has an upper storage bin 30 and a lower storage bin 32 formed therein. The upper storage bin 30 is a smaller bin utilized to hold game manuals and other miscellaneous items associated with playing video games. The lower storage bin 32 is a larger bin utilized joy sticks and other larger miscellaneous items associated with playing video games. The rear wall 20 has a plurality of holes 34 formed therethrough extending inwardly of the first rectangular opening 24 in the front wall 18. The plurality of holes 34 allow cords from a video game to extend outwardly of the cabinet 12. The two side walls 22 each have a handle 36 secured thereto. One of the two side walls 22 has a remote control holder 38 secured thereto. The remote control holder 38 could be used to hold game pads. The bottom end 16 has four casters 40 secured to each of four corners thereof. The four casters 40, or small wheels could be incorporated, are used to transport the device 10 with the aid of the handles 36 on the two side walls 22.

The device 10 contains a pair of doors 44 hingedly secured to the front wall 18 of the cabinet 12. The pair of doors 44 serve to cover the front wall 18 of the cabinet 12. The pair of doors 44, when closed, cover the entire surface of the front wall 18 thereby making the cabinet more aesthetically appealing so people don't have to look at the miscellaneous items within the cabinet 12.

The device 10 contains a sliding shelf 48 slidably coupled to a lower surface within the first rectangular opening 24 of the cabinet 12. The sliding shelf 48 comprises a U-shaped bracket 50 secured to the lower surface of the first rectangular opening 24. The sliding shelf 48 having a securement portion 52 secured thereto slidably engaging the U-shaped bracket 50 for the sliding in and out of the sliding shelf 48. The sliding shelf 48 is used for a system unit. The sliding shelf 48 is preferably large enough to hold existing storage systems available and also large enough to accommodate more than one system because of the rising trend of user's with more than one video game system. The sliding shelf 48 could be alternately used to hold a VCR or laser disc system or any other electronic component.

The device 10 contains a plurality of retractable reels 56 secured to the rear wall 20 of the cabinet 12. One of the retractable reels 56 is adapted for use with an AC power cord. One or more of the other retractable reels 56 is adapted for game remote control units. The plurality of retractable reels are comprised of low tension, retractable spools that allow the user to keep the game remote control unit cords and the AC power cords to be neatly stored. When the remote control unit and the AC power cord is needed, the user could simply pull the unit to use the remote control. The plurality of retractable reels 56 could be an optional accessory for the device 10. The reels 56 are adaptable to differing remote control units of differing video game systems.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. An electronic game storage cart for storing games and game cartridges comprising, in combination:

a cabinet having a top end, a bottom end, a front wall, a rear wall, and two side walls, the front wall having a first rectangular opening therein, the front wall having a plurality of rectangular openings therein disposed beneath the first rectangular opening, the plurality of rectangular openings having drawers removably coupled therein, the front wall having an upper storage bin and a lower storage bin formed therein, the rear wall having a plurality of holes formed therethrough extending inwardly of the first rectangular opening in the front wall, the two side walls each having a handle secured thereto, one of the two side walls having a remote control holder secured thereto, the bottom end having four casters secured to each of four corners thereof;

a pair of doors hingedly secured to the front wall of the cabinet, the pair of doors serving to cover the front wall of the cabinet;

a sliding shelf slidably coupled to a lower surface within the first rectangular opening of the cabinet, the sliding shelf comprising a U-shaped bracket secured to the lower surface of the first rectangular opening, the sliding shelf having a securement portion secured thereto slidably engaging the U-shaped bracket for the sliding in and out of the sliding shelf;

a plurality of retractable reels secured to the rear wall of the cabinet, one of the retractable reels being adapted for use with an AC power cord, one or more of the other retractable reels being adapted for game remote control units.

2. A storage cart comprising in combination:

a cabinet having a first rectangular opening through a front wall thereof, the front wall having a plurality of rectangular openings therein disposed beneath the first rectangular opening, the plurality of rectangular openings in the cabinet having drawers removably coupled therein, the front wall having an upper storage bin and a lower storage bin formed therein, a rear wall having a plurality of holes formed therethrough extending inwardly of the first rectangular opening in the front wall, the cabinet having four casters secured to each of four corners of a lower surface thereof, a side wall of the cabinet having a remote control holder secured thereto;

a sliding shelf slidably coupled to a lower surface within the first rectangular opening of the cabinet, the sliding shelf comprising a U-shaped bracket secured to the lower surface of the first rectangular opening, the sliding shelf having a securement portion secured thereto slidably engaging the U-shaped bracket for the sliding in and out of the sliding shelf;

a plurality of retractable reels secured to the rear wall of the cabinet, one of the retractable reels being adapted for use with an AC power cord, one or more of the other retractable reels being adapted for game remote control units;

a pair of doors hingedly secured to the front wall of the cabinet, the pair of doors serving to cover the front wall of the cabinet;

the plurality of rectangular openings in the cabinet having drawers removably coupled therein.

* * * * *